US011810499B2

(12) United States Patent
Wu et al.

(10) Patent No.: US 11,810,499 B2
(45) Date of Patent: Nov. 7, 2023

(54) MICRO-LIGHT-EMITTING DIODE DISPLAY PANEL

(71) Applicant: Prilit Optronics, Inc., Tainan (TW)

(72) Inventors: Biing-Seng Wu, Tainan (TW); Hsin-Hung Chen, Tainan (TW); Hsing-Ying Lee, Tainan (TW)

(73) Assignee: Prilit Optronics, Inc., Tainan (TW)

( * ) Notice: Subject to any disclaimer, the term of this patent is extended or adjusted under 35 U.S.C. 154(b) by 0 days.

(21) Appl. No.: 17/844,630

(22) Filed: Jun. 20, 2022

(65) Prior Publication Data

US 2023/0245614 A1 Aug. 3, 2023

Related U.S. Application Data

(60) Provisional application No. 63/304,230, filed on Jan. 28, 2022.

(51) Int. Cl.
*G09G 3/32* (2016.01)

(52) U.S. Cl.
CPC ..... *G09G 3/32* (2013.01); *G09G 2310/08* (2013.01)

(58) Field of Classification Search
CPC ..... G09G 3/32; G09G 2310/08
See application file for complete search history.

(56) References Cited

U.S. PATENT DOCUMENTS

| | | | | |
|---|---|---|---|---|
| 10,950,167 | B1 * | 3/2021 | Chan | G09G 3/3266 |
| 2018/0092173 | A1 * | 3/2018 | Wu | H01L 25/0753 |
| 2018/0122286 | A1 * | 5/2018 | Wu | G09G 3/32 |
| 2019/0278135 | A1 * | 9/2019 | Woodgate | G02B 19/0028 |
| 2019/0347985 | A1 * | 11/2019 | Shaeffer | H05B 45/20 |
| 2021/0264848 | A1 * | 8/2021 | Yamashita | G09G 3/2011 |

* cited by examiner

*Primary Examiner* — Muhammad N Edun
(74) *Attorney, Agent, or Firm* — Donald E. Stout; Stout, Uxa & Buyan, LLP

(57) ABSTRACT

A micro-light-emitting diode (microLED) display panel includes a display area divided into a plurality of blocks; a plurality of drivers that drive microLEDs of the blocks respectively; and at least one timing controller that controls the drivers. In each block, anodes of microLEDs in a same row are connected to a corresponding data line, and cathodes of microLEDs in a same column are connected to a corresponding common line.

9 Claims, 6 Drawing Sheets

MICRO-LIGHT-EMITTING DIODE DISPLAY PANEL

CROSS-REFERENCE TO RELATED APPLICATIONS

This application claims the benefit of U.S. Provisional Application No. 63/304,230, filed on Jan. 28, 2022, the entire contents of which are herein expressly incorporated by reference.

BACKGROUND OF THE INVENTION

1. Field of the Invention

The present invention generally relates to a microLED display panel, and more particularly to a microLED display panel with enhanced display quality.

2. Description of Related Art

A micro-light-emitting diode (microLED, mLED or μ LED) display panel is one of flat display panels, and is composed of microscopic microLEDs each having a size of 1-100 micrometers. Compared to conventional liquid crystal display panels, the microLED display panels offer better contrast, response time and energy efficiency. Although both organic light-emitting diodes (OLEDs) and microLEDs possess good energy efficiency, the microLEDs, based on group III/V (e.g., GaN) LED technology, offer higher brightness, higher luminous efficacy and longer lifespan than the OLEDs.

As the resolution of the microLED display panel increases, the amount of drivers for driving the microLEDs increases accordingly, thereby incurring voltage drop effect due to impedance and parasitic capacitance of metal wires and thus causing the microLED display panel to malfunction. Further, the amount of scan lines increases proportionally, thereby resulting in shorter scan duration for individual scan lines under the same frame rate and thus suffering granularity of gray level in display quality. Moreover, the amount of common terminals increases proportionally, thereby substantially increasing overall cost.

A need has thus arisen to propose a novel scheme for overcoming drawbacks of the conventional microLED display panels.

SUMMARY OF THE INVENTION

In view of the foregoing, it is an object of the embodiment of the present invention to provide a microLED display panel capable of effectively preventing voltage drop effect and enhancing display quality.

According to one embodiment, a micro-light-emitting diode (microLED) display panel includes a display area, a plurality of drivers and at least one timing controller. The display area is divided into a plurality of blocks. The drivers drive microLEDs of the blocks respectively. The timing controller controls the drivers. In each block, anodes of microLEDs in a same row are connected to a corresponding data line, and cathodes of microLEDs in a same column are connected to a corresponding common line. According to another embodiment, any two adjacent blocks are driven by only one driver.

DETAILED DESCRIPTION OF THE INVENTION

Figure 1A:
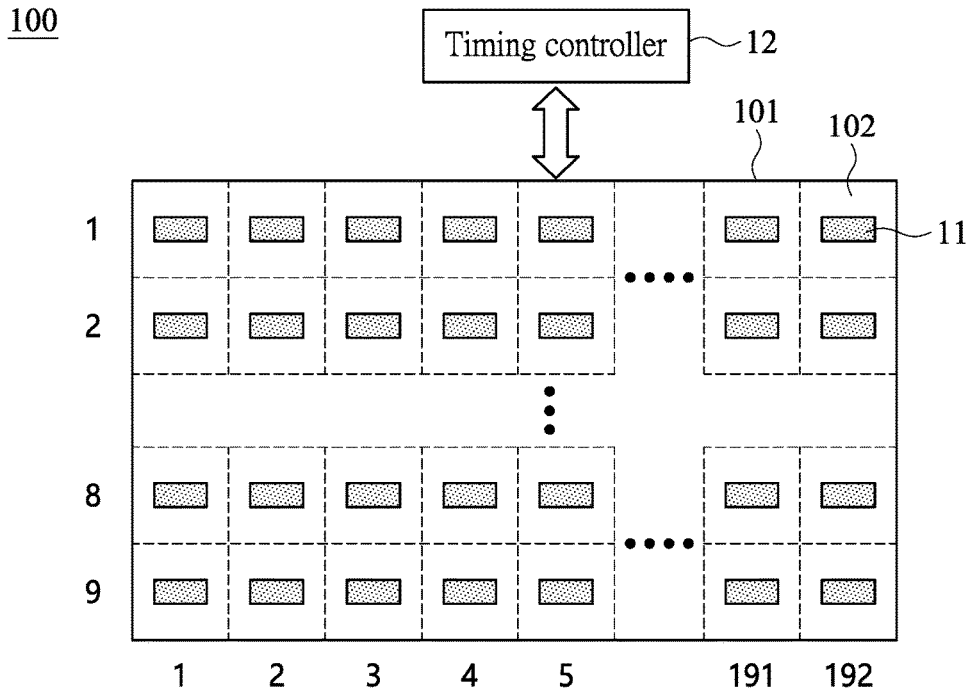
FIG. 1A schematically shows a top view illustrating a micro-light-emitting diode (microLED) display panel according to a first embodiment of the present invention.

FIG. 1A schematically shows a top view illustrating a micro-light-emitting diode (microLED) display panel 100 according to a first embodiment of the present invention. Specifically, a display area 101 of the microLED display panel 100 is divided into a plurality of blocks 102 (or display units), each of which is driven by a corresponding driver 11 such as an integrated circuit. The microLED display panel 100 may include at least one timing controller 12 configured to control the drivers 11. In the embodiment, the display area 101 is divided into 1728 blocks 102 (with 1728 drivers 11), which are arranged in 192 columns and 9 rows.

Figure 1B:
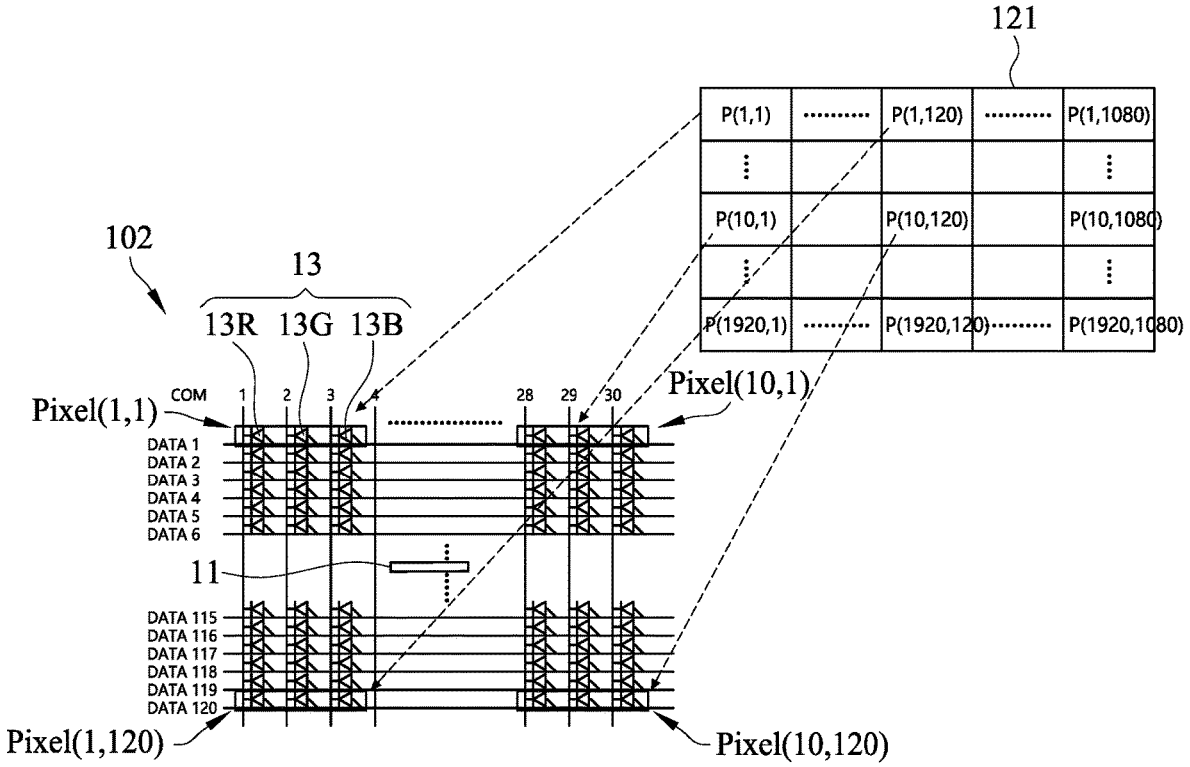
FIG. 1B shows a circuit diagram of a block and a frame buffer (of the timing controller) for storing pixel data of the microLED display panel of FIG. 1A.
Figure 1C:
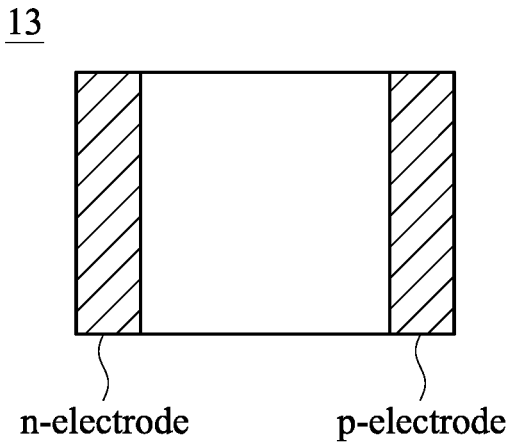
FIG. 1C and FIG. 1D schematically show top views of a microLED.
Figure 1D:
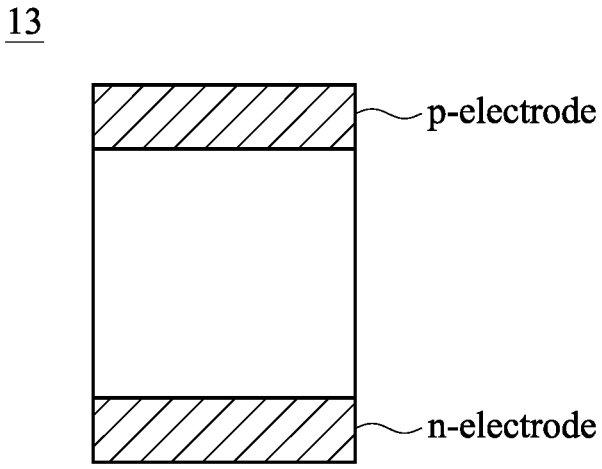

FIG. 1B shows a circuit diagram of a block 102 and a frame buffer 121 (of the timing controller 12) for storing pixel data of the microLED display panel 100 of FIG. 1A. Specifically, the block 102 may include a plurality of microLEDs 13, composed of columns of red microLEDs 13R, green microLEDs 13G and blue microLEDs 13B that are respectively disposed in turns, on a substrate (e.g., glass substrate). According to one aspect of the embodiment, anodes of microLEDs 13 in a same row are connected to a corresponding data line (DATA), and cathodes of microLEDs 13 in a same column are connected to a corresponding common line (COM) (which is connected to the driver 11 and is further connected to the timing controller 12 via other blocks 102). A red microLED 13R, a green microLED 13G and a blue microLED 13B that are laterally (or horizontally) adjacent to one another construct a pixel. In the embodiment, the resolution of the microLED display panel 100 is 1920RGB (H)×1080 (V), and the resolution of each block 102 is 30 (H)×120 (V). Therefore, in each block 102, the corresponding driver 11 has data terminals electrically connected to the data lines DATA 1-DATA 120, and common terminals electrically connected to the common lines COM 1-COM 30. It is noted that the vertical resolution (e.g., 120) and the amount of common terminals (e.g., 30) are multiples of 3. The microLED 13 of the embodiment may be a p-n diode with electrodes (i.e., p-electrode (or anode) and n-electrode (or cathode)) respectively disposed on left- and right-hand sides thereof, as illustrated in FIG. 1C, which schematically shows a top view of a microLED 13. Alternatively, the electrodes of the microLED 13 may be respectively disposed on top and bottom thereof, as illustrated in FIG. 1D, which schematically shows a top view of a microLED 13.

Figure 2A:
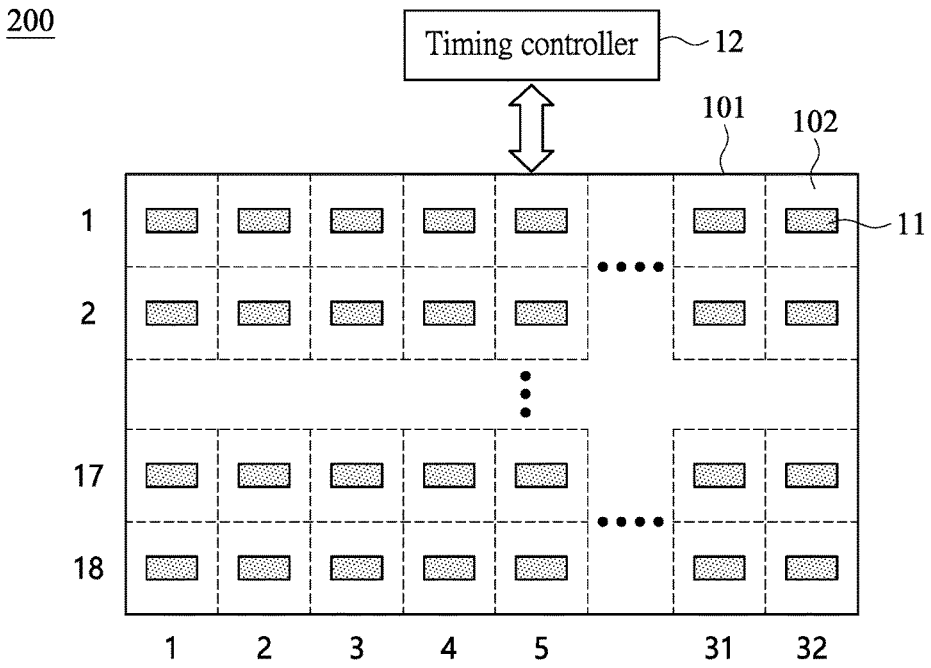
FIG. 2A schematically shows a top view illustrating a microLED display panel without adopting the feature of the embodiment in FIGS. 1A-1B.

FIG. 2A schematically shows a top view illustrating a microLED display panel 200 without adopting the feature of the embodiment in FIGS. 1A-1B. Specifically, the display area 101 is divided into 576 blocks 102 (with 576 drivers 11), which are arranged in 32 columns and 18 rows.

Figure 2B:
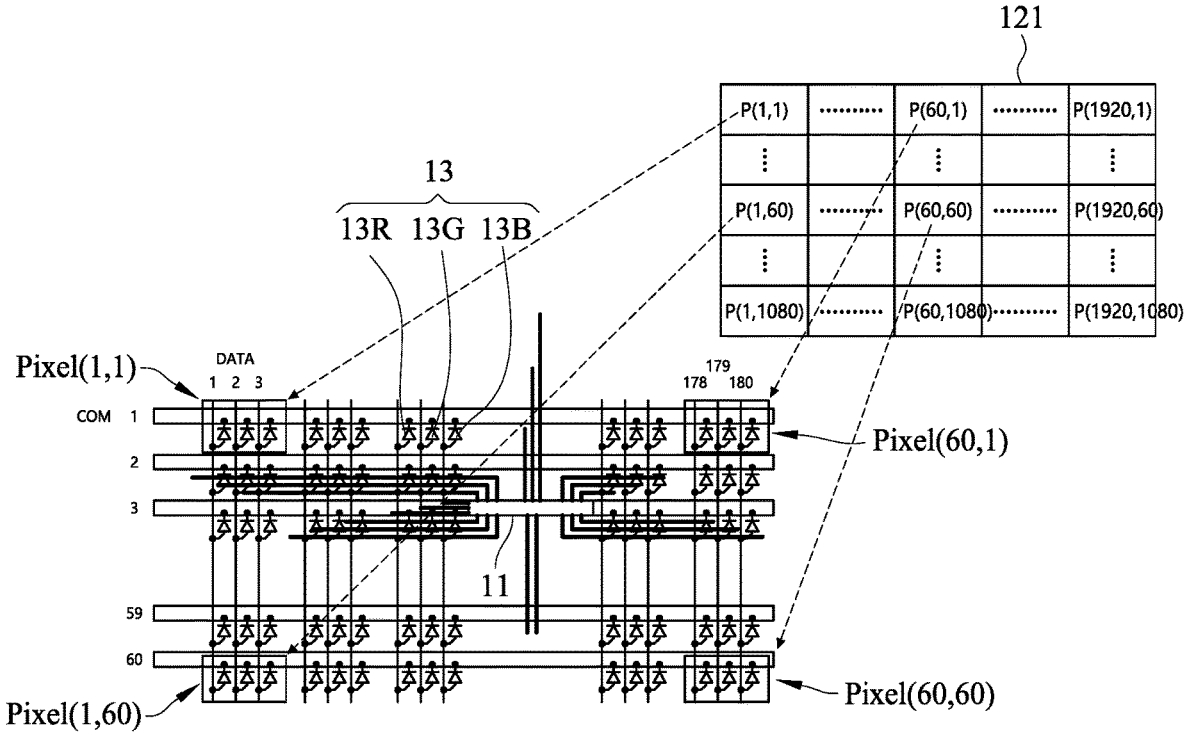
FIG. 2B shows a circuit diagram of a block and a frame buffer for storing pixel data of the microLED display panel of FIG. 2A.

FIG. 2B shows a circuit diagram of a block 102 and a frame buffer 121 (of the timing controller 12) for storing pixel data of the microLED display panel 200 of FIG. 2A. Specifically, the block 102 may include a plurality of microLEDs 13, composed of columns of red microLEDs 13R, green microLEDs 13G and blue microLEDs 13B that are respectively disposed in turns. As shown in FIG. 2B, anodes of microLEDs 13 in a same column are connected to a corresponding data line (DATA), and cathodes of microLEDs 13 in a same row are connected to a corresponding common line (COM). A red microLED 13R, a green microLED 13G and a blue microLED 13B that are laterally adjacent to one another construct a pixel. The resolution of the microLED display panel 200 is 1920RGB (H)×1080 (V), and the resolution of each block 102 is 60RGB (H)×60 (V). Therefore, in each block 102, the corresponding driver 11 has data terminals electrically connected to the data lines DATA 1-DATA 180, and common terminals electrically connected to the common lines COM 1-COM 60.

It is noted that, as there are 18 drivers 11 in each column, the microLED display panel 200 of FIGS. 2A-2B may suffer voltage drop effect due to impedance and parasitic capacitance of metal wires. To the contrary, as there are only 9 drivers 11 in each column, the microLED display panel 100 of FIGS. 1A-1B can effectively prevent voltage drop effect and increase individual scan duration while maintaining the frame rate.

Figure 3A:
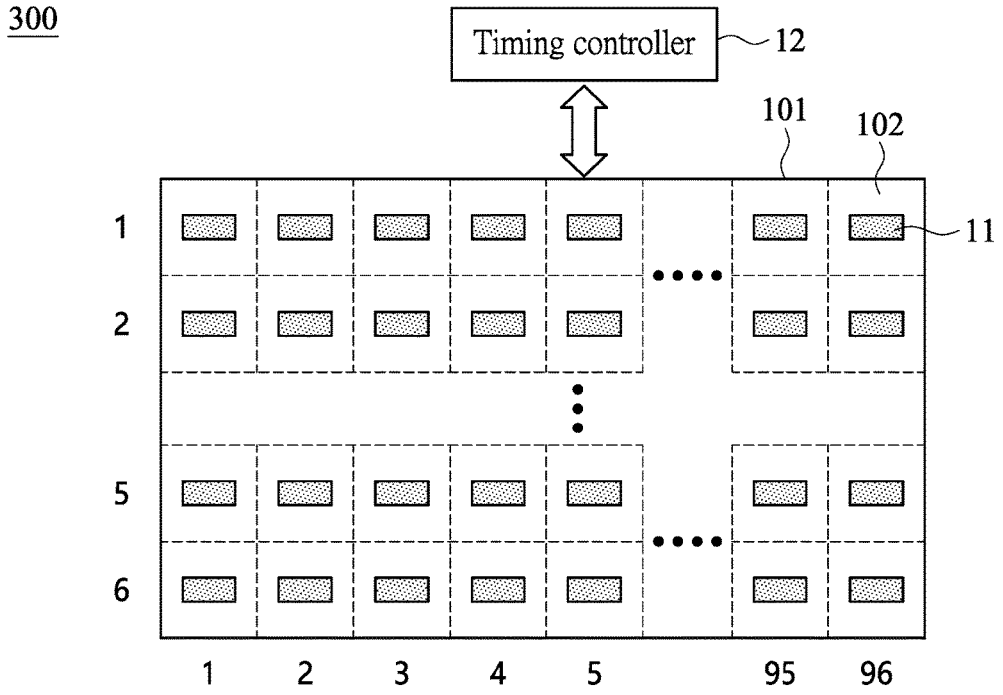
FIG. 3A schematically shows a top view illustrating a microLED display panel according to a second embodiment of the present invention.

FIG. 3A schematically shows a top view illustrating a microLED display panel 300 according to a second embodiment of the present invention. In the embodiment, the display area 101 is divided into 576 blocks 102 (with 576 drivers 11), which are arranged in 96 columns and 6 rows.

Figure 3B:
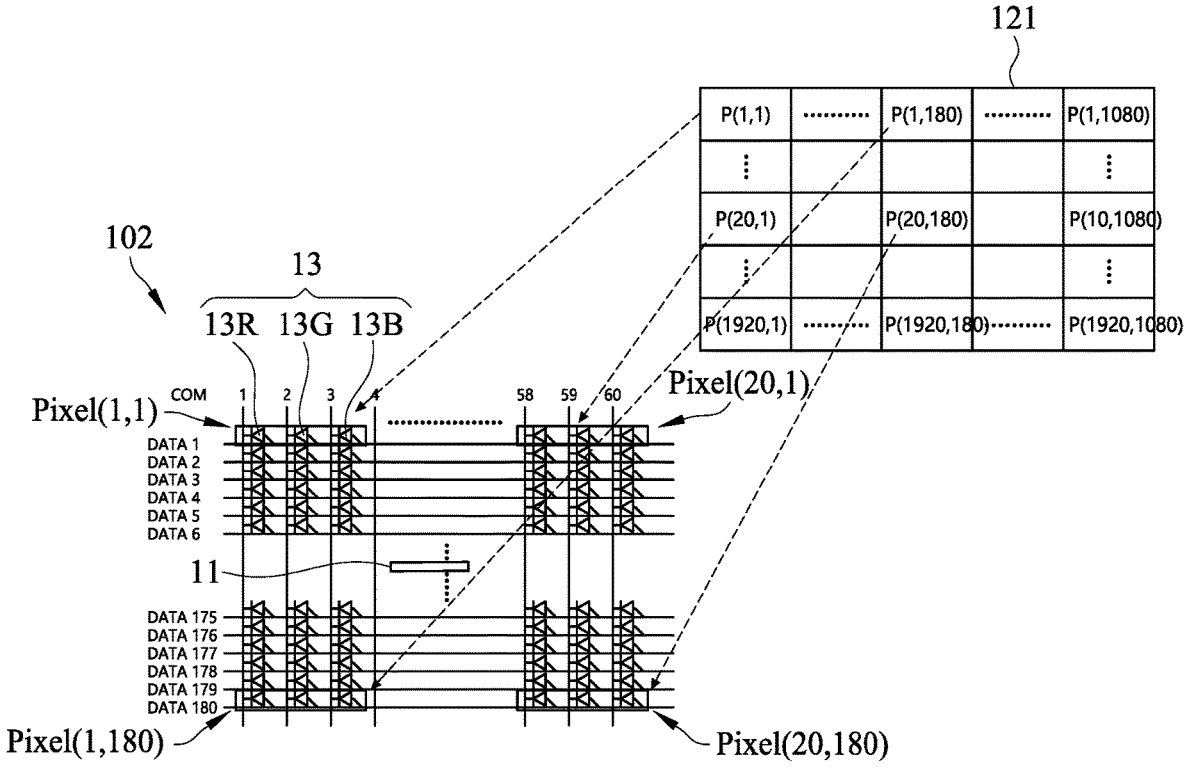
FIG. 3B shows a circuit diagram of a block and a frame buffer for storing pixel data of the microLED display panel of FIG. 3A.

FIG. 3B shows a circuit diagram of a block 102 and a frame buffer 121 (of the timing controller 12) for storing pixel data of the microLED display panel 300 of FIG. 3A. Specifically, the block 102 may include a plurality of microLEDs 13, composed of columns of red microLEDs 13R, green microLEDs 13G and blue microLEDs 13B that are respectively disposed in turns. According to one aspect of the embodiment, anodes of microLEDs 13 in a same row are connected to a corresponding data line (DATA), and cathodes of microLEDs 13 in a same column are connected to a corresponding common line (COM). A red microLED 13R, a green microLED 13G and a blue microLED 13B that are laterally adjacent to one another construct a pixel. In the embodiment, the resolution of the microLED display panel 300 is 1920RGB (H)×1080 (V), and the resolution of each block 102 is 60 (H)×180 (V). Therefore, in each block 102, the corresponding driver 11 has data terminals electrically connected to the data lines DATA 1-DATA 180, and common terminals electrically connected to the common lines COM 1-COM 60. As there are only 6 drivers 11 in each column, the microLED display panel 300 of FIGS. 3A-3B can effectively prevent voltage drop effect and increase individual scan duration.

Figure 4A:
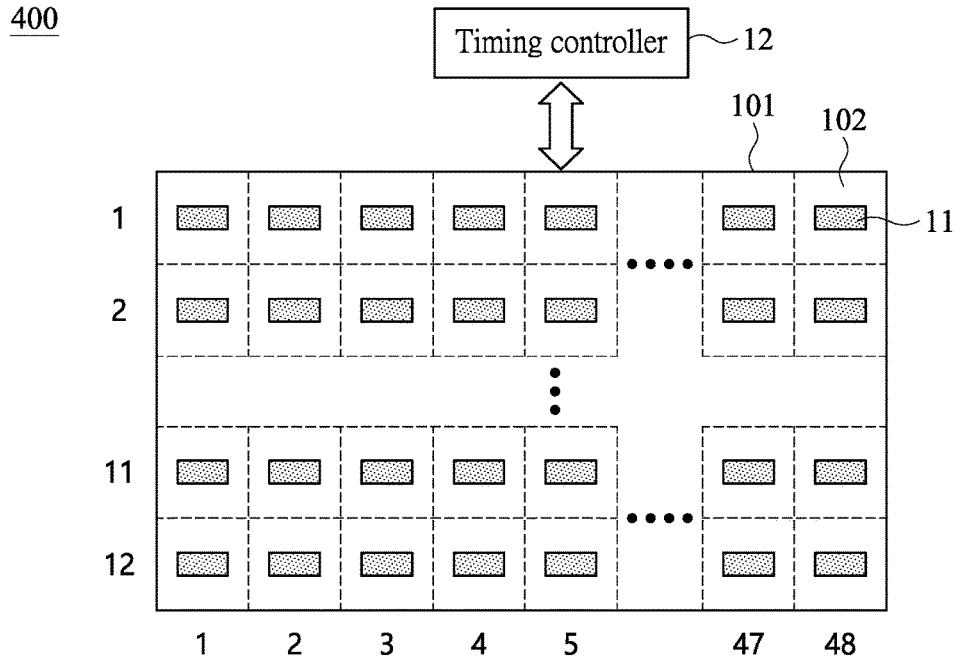
FIG. 4A schematically shows a top view illustrating a microLED display panel according to a third embodiment of the present invention.

FIG. 4A schematically shows a top view illustrating a microLED display panel 400 according to a third embodiment of the present invention. In the embodiment, the display area 101 is divided into 576 blocks 102 (with 576 drivers 11), which are arranged in 48 columns and 12 rows.

Figure 4B:
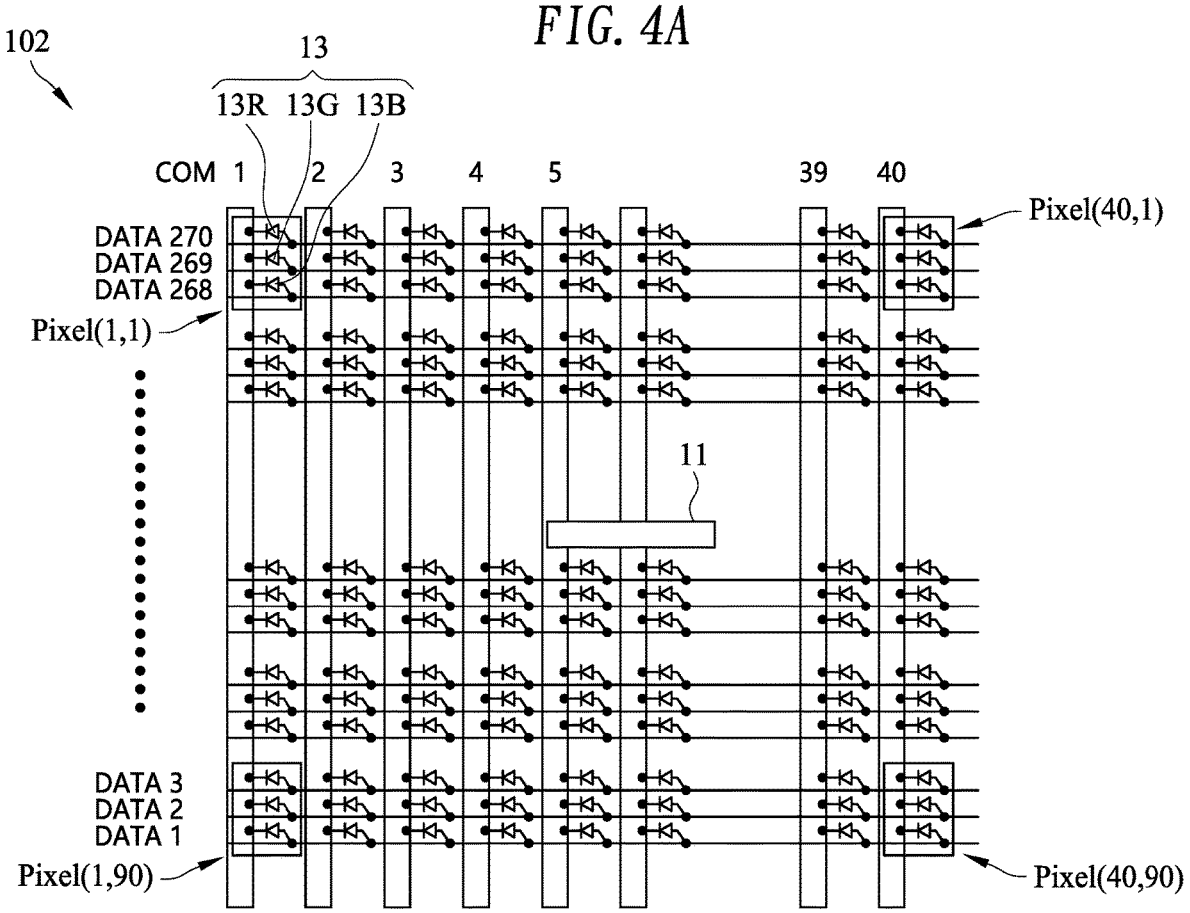
FIG. 4B shows a circuit diagram of a block of the microLED display panel of FIG. 4A.

FIG. 4B shows a circuit diagram of a block 102 of the microLED display panel 400 of FIG. 4A. Specifically, the block 102 may include a plurality of microLEDs 13, composed of rows of red microLEDs 13R, green microLEDs 13G and blue microLEDs 13B that are respectively disposed in turns. According to one aspect of the embodiment, anodes of microLEDs 13 in a same row are connected to a corresponding data line (DATA), and cathodes of microLEDs 13 in a same column are connected to a corresponding common line (COM). A red microLED 13R, a green microLED 13G and a blue microLED 13B that are longitudinally (or vertically) adjacent to one another construct a pixel. In the embodiment, the resolution of the microLED display panel 400 is 1920 (H)×1080RGB (V), and the resolution of each block 102 is 40 (H)×270 (V). Therefore, in each block 102, the corresponding driver 11 has data terminals electrically connected to the data lines DATA 1-DATA 270, and common terminals electrically connected to the common lines COM 1-COM 40. As there are only 12 drivers 11 in each column, the microLED display panel 400 of FIGS. 4A-4B can effectively prevent voltage drop effect and increase individual scan duration.

Figure 5A:
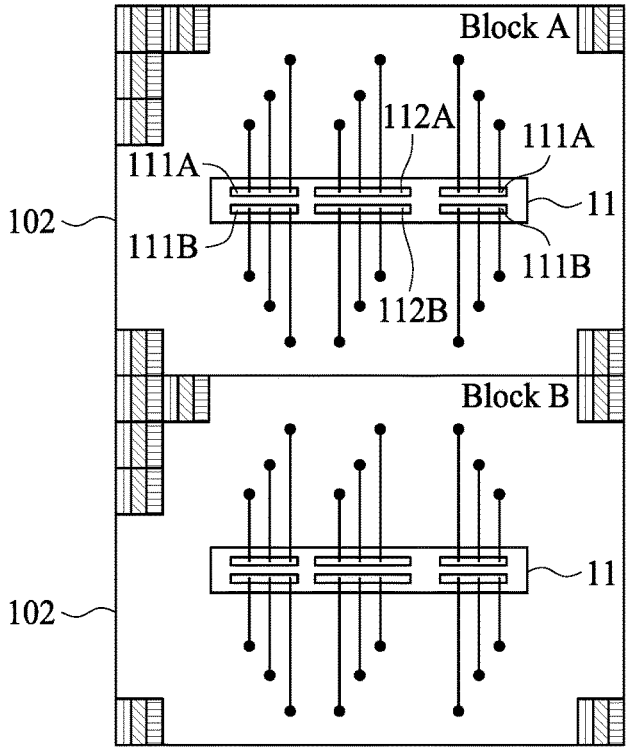
FIG. 5A schematically shows a top view illustrating two blocks driven by two drivers respectively.

FIG. 5A schematically shows a top view illustrating two blocks 102 (e.g., block A and block B) driven by two drivers 11 respectively. Specifically, for each block 102, data terminals 111A in top rows and data terminals 111B in bottom rows are electrically connected to data lines of corresponding block 102, and common terminals 112A in top row and common terminals 112B in bottom row are electrically connected to common lines of corresponding block 102.

Figure 5B:
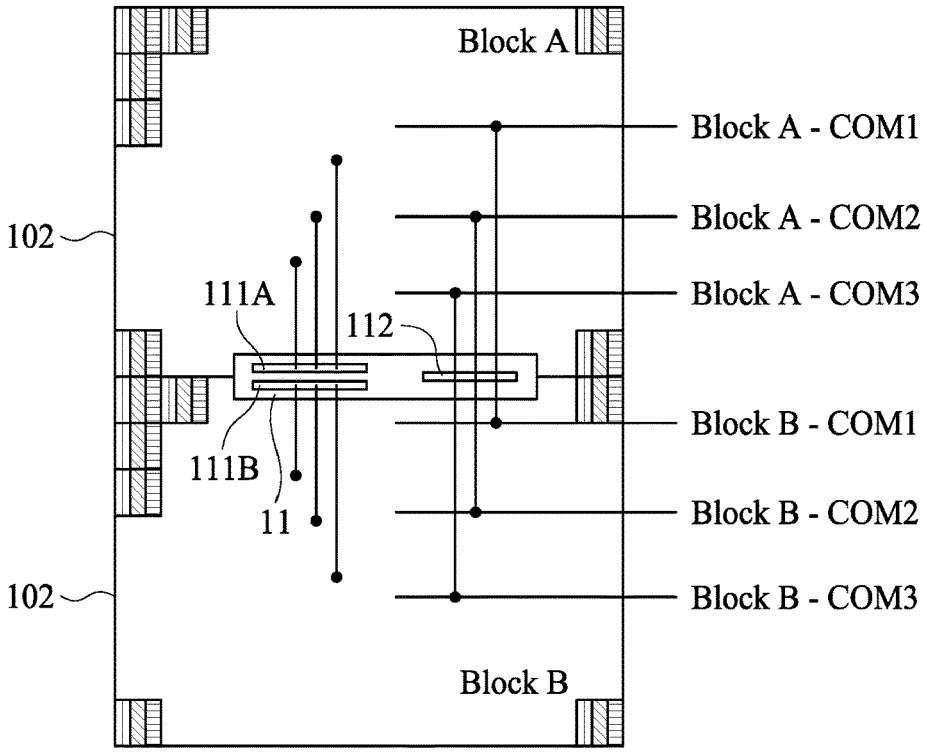
FIG. 5B schematically shows a top view illustrating two blocks driven by only one driver.

FIG. 5B schematically shows a top view illustrating two (adjacent) blocks 102 (e.g., block A and block B) driven by only one driver 11. Specifically, data terminals 111A in top (or first) row (of the driver 11) are electrically connected to data lines of a top (or first) block 102 (e.g., block A); data terminals 111B in bottom (or second) row (of the driver 11) are electrically connected to data lines of a bottom (or second) block 102 (e.g., block B); and common terminals 112 (of the driver 11) are electrically connected to, and shared by, common lines of both blocks 102 (e.g., block A and block B). Compared to FIG. 5A, a microLED display panel adopting the scheme of FIG. 5B requires fewer drivers 11 and common terminals 112, thereby effectively preventing voltage drop.

Although specific embodiments have been illustrated and described, it will be appreciated by those skilled in the art that various modifications may be made without departing from the scope of the present invention, which is intended to be limited solely by the appended claims.

What is claimed is:

1. A micro-light-emitting diode (microLED) display panel, comprising:

a display area divided into a plurality of blocks;

a plurality of drivers that drive microLEDs of the blocks respectively; and at least one timing controller that controls the drivers;

wherein, in each block, anodes of microLEDs in a same row are connected to a corresponding data line, and cathodes of microLEDs in a same column are connected to a corresponding common line which is connected to a corresponding driver and is further connected to a corresponding timing controller via drivers of other blocks.

2. The panel of claim 1, wherein the microLEDs of each block comprise columns of red microLEDs, green microLEDs and blue microLEDs that are respectively disposed in turns on a substrate.

3. The panel of claim 2, wherein a red microLED, a green microLED and a blue microLED that are laterally adjacent to one another construct a pixel.

4. The panel of claim 1, wherein each microLED of the block comprises a p-n diode with electrodes respectively disposed on left- and right-hand sides thereof.

5. The panel of claim 1, wherein each microLED of the block comprises a p-n diode with electrodes respectively disposed on top and bottom thereof.

6. The panel of claim 1, wherein the microLEDs of each block comprise rows of red microLEDs, green microLEDs and blue microLEDs that are respectively disposed in turns on a substrate.

7. The panel of claim 6, wherein a red microLED, a green microLED and a blue microLED that are longitudinally adjacent to one another construct a pixel.

8. A micro-light-emitting diode (microLED) display panel, comprising:

a display area divided into a plurality of blocks;

a plurality of drivers that drive microLEDs of the blocks; and at least one timing controller that controls the drivers;

wherein any two adjacent blocks are driven by only one driver.

9. The panel of claim 8, wherein data terminals in a first row of the driver are electrically connected to data lines of a first block, data terminals in a second row of the driver are electrically connected to data lines of a second block, and common terminals of the driver are electrically connected to, and shared by, common lines of both the first block and the second block.

* * * * *